US007443957B2

(12) United States Patent
Freudenberger et al.

(10) Patent No.: US 7,443,957 B2
(45) Date of Patent: Oct. 28, 2008

(54) X-RAY APPARATUS WITH A COOLING DEVICE THROUGH WHICH COOLING FLUID FLOWS

(75) Inventors: Jörg Freudenberger, Eckental (DE); Ernst Neumeier, Aurachtal (DE); Peter Röhrer, Uttenreuth (DE); Matthias Seufert, Pettstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/545,666

(22) Filed: Oct. 10, 2006

(65) Prior Publication Data

US 2007/0086573 A1 Apr. 19, 2007

(30) Foreign Application Priority Data

Oct. 14, 2005 (DE) ..... 10 2005 049 270

(51) Int. Cl.
*H01J 35/12* (2006.01)

(52) U.S. Cl. ..... 378/130; 378/141

(58) Field of Classification Search ..... 378/130, 378/141, 119, 199–200
See application file for complete search history.

(56) References Cited

U.S. PATENT DOCUMENTS

| | | | | |
|---|---|---|---|---|
| 4,130,772 | A | 12/1978 | Küssel et al. | |
| 4,405,876 | A * | 9/1983 | Iversen | 313/30 |
| 4,477,921 | A * | 10/1984 | Armini et al. | 378/34 |
| 4,622,687 | A | 11/1986 | Whitaker et al. | |
| 4,945,562 | A | 7/1990 | Staub | |
| 5,541,975 | A | 7/1996 | Anderson et al. | |
| 5,579,364 | A | 11/1996 | Osaka et al. | |
| 6,364,527 | B1 * | 4/2002 | Kutschera | 378/200 |
| 6,519,317 | B2 * | 2/2003 | Richardson et al. | 378/130 |
| 2005/0025282 | A1 * | 2/2005 | Freudenberger et al. | 378/119 |

FOREIGN PATENT DOCUMENTS

| | | |
|---|---|---|
| DE | 36 44719 C1 | 3/1983 |
| DE | 103 35 664 B3 | 6/2005 |

* cited by examiner

*Primary Examiner*—Hoon Song
(74) *Attorney, Agent, or Firm*—Schiff Hardin LLP

(57) ABSTRACT

An x-ray apparatus has a cooling device for cooling of the anode, through which cooling device cooling fluid flows. To improve the cooling effect, the coolant is water and a pressure generation device is provided for generation of a water pressure of more than 1.1 bar acting at least in a region of the anode to be cooled.

6 Claims, 2 Drawing Sheets

X-RAY APPARATUS WITH A COOLING DEVICE THROUGH WHICH COOLING FLUID FLOWS

BACKGROUND OF THE INVENTION

1. Field of the Invention

The present invention concerns an x-ray apparatus according to the preamble of the type having a cooling device for cooling the anode through which a fluid coolant flows.

2. Description of the Prior Art

X-ray tubes with a high load capacity are conventionally used in the field of x-ray computed tomography. These can be either x-ray tubes with a rotary anode as are known, for example, from DE 40 12 019 B4 or U.S. Pat. No. 5,541,975 or rotating envelope tubes as they are, for example, known from DE 103 35 664 B3. Cooling devices for dissipation of the heat generated in the anode are provided. In rotary anodes the cooling device extends in an anode shaft (fashioned hollow) and/or in the anode plate (fashioned hollow). In rotating envelope tubes a vacuum housing embodying the anode is surrounded by the cooling device. An electrically-insulating oil or a thermally insulating oil typically flows through the cooling device as a coolant. In addition to the property of electrical isolation, thermally insulating oil can be used given a working temperature of 200° C. due to its relatively high boiling point. However, insulating oil disadvantageously exhibits only a relatively low heat capacity, meaning the heat accumulating at the anode cannot be dissipated particularly efficiently with such insulating oil. Apart from this the insulating oil is highly mobile. A durable, complete sealing of the cooling device can be realized only with difficulty in practice. To overcome this disadvantage it has been proposed according to U.S. Pat. No. 5,541,975 to use liquid metal as a coolant, but this is expensive and complicated.

SUMMARY OF THE INVENTION

An object of the present invention is to provide x-ray apparatus with a cooling device that avoids the disadvantages according to the prior art. An x-ray apparatus that can be produced as simply as possible, with a particularly effective and durable cooling device, should be achieved. A further object is in the specification of a suitable coolant.

The above object is achieved in accordance with the invention by an x-ray apparatus having a cooling device wherein the coolant is water and a pressure generation device is provided to generate a water pressure of at least 1.1 bar acting in at least one region of the anode to be cooled.

The heat capacity of water is higher by approximately 2.5 times than that of insulating oil. A particularly effective heat dissipation thus can be realized by using water as the coolant. By maintaining a water pressure of at least 1.1 bar by means of the pressure generation device in a region of the anode to be cooled, the boiling point of the water is increased and thus an unwanted formation of a vapor film between the region to be cooled and the water is avoided. The "region of the anode to be cooled" means a region in which the maximum temperature is generated during operation. In the case of a rotary anode as well as a rotating envelope tube, this is thereby an annular region. A cooling device operated with water as a cooling fluid normally can be reliably sealed for a long time span. The inventive x-ray apparatus has a long lifespan and is characterized by a particularly efficient cooling.

The water pressure is advantageously more than 5 bar, preferably at least 10 bar. The water pressure is set such that the formation of an unwanted vapor film in the region to be cooled is safely and reliably avoided. It has proven to be particularly appropriate to generate a water pressure of at least 10 bar, at least in the region of the anode to be cooled. The boiling point of the water in this case is approximately 180° C.

Additives can be added to the water used as a cooling fluid. These can be additives that lower the freezing point and/or counteract a corrosion of the cooling device through which the cooling fluid flows.

In an embodiment of the invention, the cooling device is connected in a fixed manner with the anode. In this case channels or hollow spaces (voids) of the cooling device surround at least the region of the anode to be cooled. It is thereby achieved that the coolant is rotated with essentially the same angular velocity as the region of the anode to be cooled. In this case the pressure generation device can be a device for rotation of the anode. The coolant is rotated essentially simultaneously with the device for rotation of the anode and with the same angular velocity. In this case centrifugal forces that generate the desired water pressure in the region of the anode to be cooled act on the coolant. In addition, the water pressure is dependent on the radius, i.e. on the distance of the region to be cooled from the rotation axis of the anode. The following relation applies:

$$\tfrac{1}{2}\rho\omega^2 R^2 = P,$$

wherein $\rho$ is the density of the coolant, $\omega$ is the rotation frequency, and P is the fluid pressure.

In this particularly simple embodiment it is not necessary to provide separate further devices for generation of a water pressure. The water pressure can be generated solely by the rotation of the cooling device connected in a fixed manner with the anode and the centrifugal forces that act upon the coolant.

In a further embodiment of the invention, the cooling device has a housing surrounding the anode. This enables a compact design of the x-ray apparatus. The housing can itself be cooled such that a heat radiated from the anode can be dissipated by the housing.

According to a further embodiment, the water flows through an intermediate space formed between the housing and the anode. In this case the housing forms, for example, the outer casing of a rotating envelope tube. The housing is advantageously connected in a fixed manner with an internal, vacuum-sealed tube housing embodying the anode. In this case the cooling fluid is rotated with the same speed as the x-ray housing. A high actuation power required to overcome the friction between the water and the tube housing in the case of high rotation speeds thus can be avoided.

According to a further embodiment of the invention, the anode can be a rotary anode. A hollow space for passage of the coolant can be provided inside the rotary anode. The hollow space can merely extend across the anode shaft, or the hollow space can extend across the anode shaft and the inside of the anode plate. This enables a particularly efficient cooling of the rotary anode.

According to a further embodiment, at least one flow conductor element is provided in the intermediate space or in the hollow space. This enables the feed of cold cooling fluid to a region of the anode to be cooled on a short path. An unwanted pre-heating of the coolant before reaching the region to be cooled thus is avoided.

The pressure generation device can has a pump. The pump can be designed such that it is driven by a drive for rotating the rotating envelope tube or the rotary anode. In this case it is ensured that the pump is always also in operation given a rotation of the anode.

According to a further embodiment, the pressure generation device has a flow deflector (baffle) arranged in the intermediate space or hollow space. The baffle can rotate or can be stationary relative to the rotation of the anode. The required water pressure can be generated in a simple manner by the relative movement between the rotating cooling fluid and the baffle. This embodiment of the pressure generation device is particularly simple and insensitive to disruptions. The baffle can be, for example, a disc provided with flow conductor loops or plates that is arranged between the tube housing and the housing. In the case of a rotatable bearing of such a disc it is possible to set a desired water pressure by the adjustment of the rotation speed of the disc relative to the rotation speed of the x-ray housing.

The above object also is achieved according to the invention, by a method including the steps of using water as a coolant in an x-ray apparatus and maintaining the water at a pressure of at least 1.1 bar in a cooling device for cooling of the anode of the x-ray apparatus is provided. The use of water as a cooling fluid enables a particularly effective cooling of the x-ray apparatus. Apart from this, seals for a cooling device operated with water as a coolant remain tight significantly longer compared to a cooling device operated with insulating oil. The inventive method enables the production of x-ray apparatuses that are cooled more effectively and are less prone to repair.

Water at a pressure of more than 5 bar (preferably at least 10 bar) is advantageously used. An increase of the boiling point is thereby achieved that enables the use of water as a coolant in conventional rotating envelope tubes or x-ray tubes with rotary anode.

DESCRIPTION OF THE PREFERRED EMBODIMENT

Figure 1:
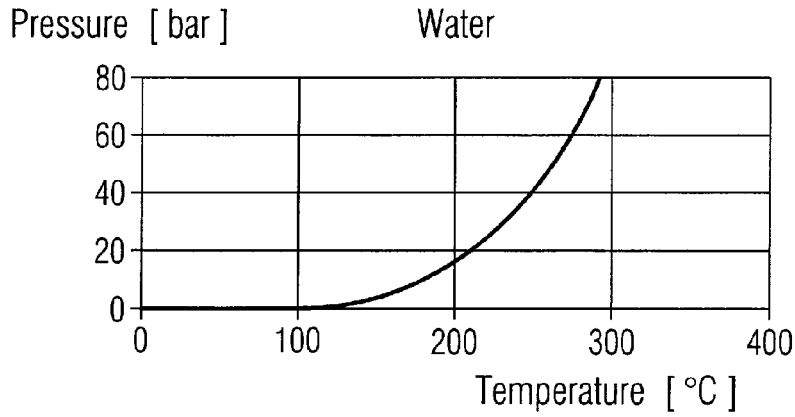
FIG. 1 is a graph showing the boiling temperature of water dependent on pressure.

As can be seen from FIG. 1, the boiling point of water increases with increasing pressure. Given a pressure of, for example, 10 bar, water can be heated up to a working temperature of approximately 180° C. without a vapor film interfering with the cooling effect forming on the surface of a region to be cooled.

Figure 2:
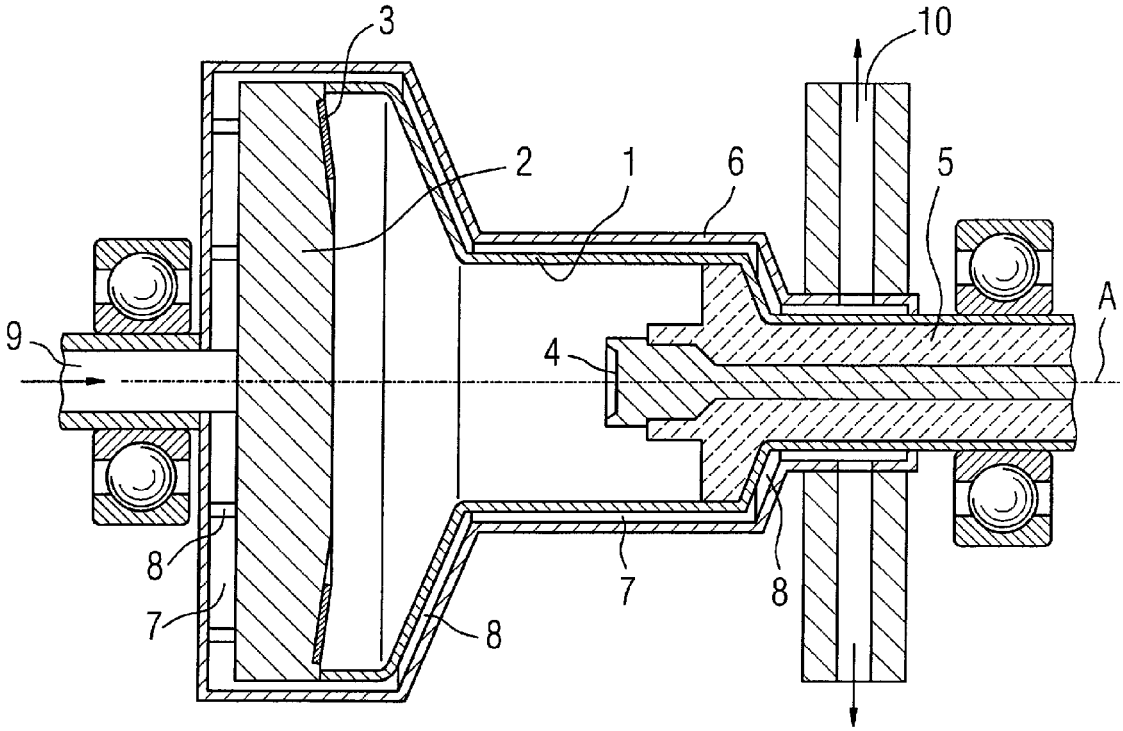
FIG. 2 is a schematic cross-sectional view of a portion of rotating envelope tube in accordance with the invention.

FIG. 2 shows an example of a rotating envelope tube. A vacuum-sealed x-ray housing 1 is borne such that it can rotate around a rotation axis A. The x-ray housing 1 comprises an anode plate 2 with an annular anode 3 mounted thereupon. A cathode 4 is borne opposite the anode plate 2 on an insulator 5, for example an $Al_2O_3$ ceramic. A housing surrounding the x-ray housing 1 is designed with the reference character 6. The housing 6 is connected in a fixed manner with the x-ray housing 1 via connection elements 8, such that an intermediate space 7 for conveyance of cooling fluid is formed between the housing 6 and the x-ray housing 1. The intermediate space 7 is connected with a coolant inlet 9 and a coolant outlet 10 for infeed and discharge of cooling fluid. An actuation device (not shown here) is provided for generation of a rotation movement of the rotating envelope tube.

The function of the rotating envelope tube is as follows:

Water as a coolant is supplied via the coolant inlet 9. The patient table (i.e. in particular the housing 6, the intermediate space 7 and the x-ray housing 1) is rotated around the rotation axis A by means of the actuation device (not shown here). Cooling fluid located in the intermediate space 7 is placed under pressure, in particular in the radially outlying regions of the anode 3, as a result of centrifugal forces. The pressure is dependent on the selected angular velocity as well as the radius. It increases with increasing radius. As a consequence the water pressure is particularly high in the radially outlying regions of the anode 3 to be cooled. The water at a specific water pressure flows through the intermediate space 7, absorbs the heat generated by the anode 3 and transports it away through the coolant outlet 10. The heat can be removed from the water via a conventional heat exchanger and the cooled water can be subsequently supplied again to the coolant inlet 9. A conventional pump or an accumulator can be used to generate the pressure.

A pump, an accumulator or a disc (that can rotate relative to the housing 6) are provided for generation of the water pressure in the intermediate space 7 extending between the anode plate 2 and the housing 6. The disc can be mounted on a shaft that extends through the coolant inlet 9 into the intermediate space 7. By means of a separate drive device the disc can be moved relative to the housing 6 with a rotation speed and/or rotation direction deviating from that of the housing 6. Flow conductor structures can be provided on the top and underside of such a disc. The flow conductor structures, given a relative movement of the disc with respect to the housing 6, effect an acceleration of the water (supplied through the coolant inlet 9 into the intermediate space 7) at the radially outlying region of the anode plate 2 to be cooled. This consequently leads to the desired formation of a water pressure of at least 10 bar in the radially outlying region of the anode plate 2.

It is also possible to produce a water pressure of at least 10 bar in the radially outlying region of the anode plate 2 by a correspondingly high rotation speed of the rotating envelope tube. In this case the water pressure is effected via the centrifugal forces acting on the supplied water and via a tapering or narrowing of the intermediate space 3 provided downstream of the radially outlying regions of the anode plate 2.

Figure 3:
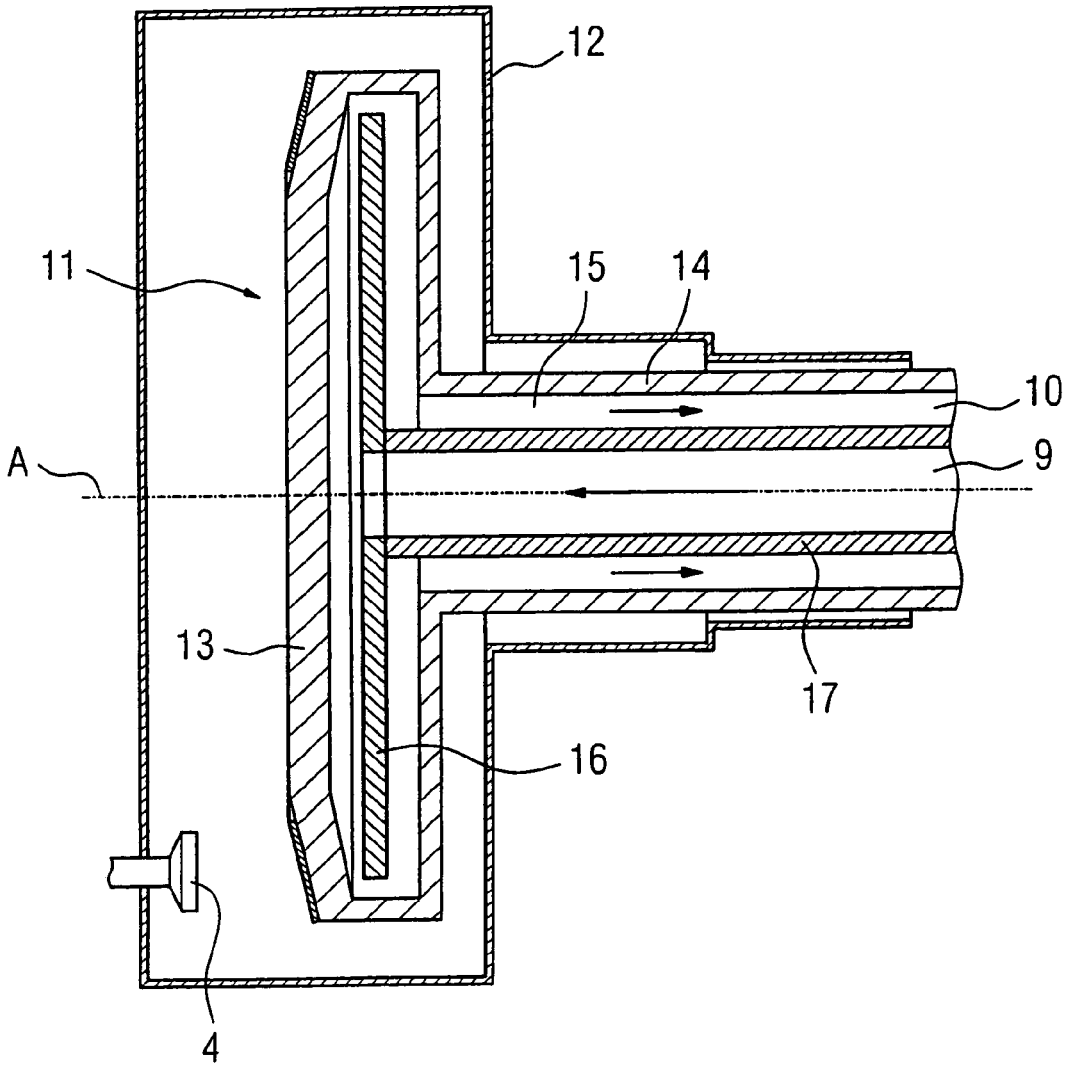
FIG. 3 is a schematic cross-sectional view of a portion of an x-ray tube with a rotary anode in accordance with the invention.

FIG. 3 shows an x-ray tube with a rotary anode 11. The rotary anode 11 is surrounded by a further vacuum-sealed tube housing 12. A rotary anode plate 13 as well as an anode shaft 14 extending from the rotary anode plate 13 are fashioned hollow. A stationary disc 16 or a disc 16 that can be moved relative to the rotary anode plate 13 is accommodated in the hollow space 15. The disc 16 is held in the hollow anode shaft 14 by means of a sleeve (hollow) shaft 17. The sleeve shaft 17 forms the coolant inlet 9. An annular gap formed between the sleeve shaft 17 and the anode shaft 14 leads to the coolant outlet 10. The cathode is designated with reference character 4.

The function of the x-ray tube with rotary anode is as follows:

Here as well water as coolant is supplied through the coolant inlet 9 at a pressure of at least 10 bar. The disc 16 acts as a flow conductor means and conducts the supplied cool water to the radially outlying region of the rotary anode plate 13. There the water absorbs the heat generated there and discharges it again through the annular gap (formed between the sleeve shaft 17 and the anode plate 14) via the coolant outlet 10.

As has already been mentioned in the preceding, in this case as well the pressure can be developed by an accumulator or a correspondingly-fashioned pump. Here as well it is also possible to provide the disc 16 with corresponding flow conductor structures, such that the water supplied through the coolant inlet 9 is accelerated (via a relative movement between the disc 16 and the rotary anode plate 13) in the direction toward the radially outlying region of the rotary anode plate 13. As a result, a water pressure of at least 10 bar develops, in particular in the region of the rotary anode plate 13 to be cooled, so the unwanted formation of a vapor film between the regions to be cooled and the water is safely and reliably avoided. At correspondingly high rotation speeds it is also possible to generate the pressure solely by the centrifugal forces acting on the water in the radially outlying region of the rotary anode plate 13 to be cooled. In this case it is appropriate to adapt an effective flow-through cross-section of the hollow space 15 downstream of the region to be cooled, such that the desired water pressure develops.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray apparatus comprising:

a rotating envelope having a vacuum-sealed tube housing that is rotatable around a rotation axis by a drive unit;

an annular anode mounted in said tube housing for co-rotation therewith, that generates heat during operation of the x-ray apparatus;

an apparatus housing surrounding said tube housing and being fixedly connected with said tube housing for co-rotation therewith by connection elements that form an intermediate space between said apparatus housing and said tube housing;

a cooling device comprising a fluid inlet in fluid communication with said intermediate space and a fluid outlet in fluid communication with said intermediate space, said cooling device circulating water in said intermediate space between said inlet and said outlet to bring said circulating water into thermal communication with said anode to transfer said heat from said anode; and said cooling device comprising a pressure generator in said rotating envelope that maintains said water at a pressure of more than 5 bar, at least in region of said anode, during operation of said x-ray apparatus exclusively due to centrifugal forces produced by rotation of said rotating envelope by said drive unit.

2. An x-ray apparatus as claimed in claim 1 wherein said pressure generator maintains said water at a pressure of more than 5 bar.

3. An x-ray apparatus as claimed in claim 1 wherein said pressure generator maintains said water at a pressure of at least 10 bar.

4. An x-ray apparatus as claimed in claim 1 wherein said cooling device comprises at least one flow conductor element disposed in said intermediate space.

5. An x-ray apparatus as claimed in claim 1 wherein said pressure generator comprises a baffle disposed in said intermediate space.

6. An x-ray apparatus as claimed in claim 1 wherein said pressure generator generates a pumping action on said water due to said centrifugal forces.

* * * * *